United States Patent [19]

Kruk

[11] Patent Number: 4,776,152

[45] Date of Patent: Oct. 11, 1988

[54] METHOD AND APPARATUS FOR OPENING ENVELOPE FLAPS

[75] Inventor: Robert R. Kruk, Crestwood, Ill.

[73] Assignee: Inscerco Mfg. Inc., Crestwood, Ill.

[21] Appl. No.: 96,342

[22] Filed: Sep. 11, 1987

[51] Int. Cl.[4] ..... B65B 43/39

[52] U.S. Cl. ..... 53/492; 53/382; 53/386

[58] Field of Search ..... 53/492, 381 R, 382, 53/386, 76

[56] References Cited

U.S. PATENT DOCUMENTS

| | | | |
|---|---|---|---|
| 3,410,053 | 11/1968 | Bonsch | 53/266 A |
| 3,583,124 | 6/1971 | Morrison | 53/492 |
| 4,318,265 | 3/1982 | Orsinger et al. | 53/492 |
| 4,551,188 | 11/1985 | Schulze | 53/382 X |

*Primary Examiner*—James F. Coan
*Attorney, Agent, or Firm*—Olson & Hierl

[57] ABSTRACT

The present invention provides a method and apparatus for rapidly opening envelope flaps to facilitate the rapid insertion of letters and other inserts. The apparatus comprises means for conveying an envelope having a closed flap, suction means including a suction member mounted on a rotatable shaft in communication with a vacuum source that is sufficient to allow the suction member to engage the surface of the closed envelope flap and rotate the flap away from the plane of the envelope without impeding advancement of the envelope along the conveyor means, and a stationary plow member positioned adjacent and downstream of the suction member to fully open the envelope flap.

23 Claims, 2 Drawing Sheets

METHOD AND APPARATUS FOR OPENING ENVELOPE FLAPS

FIELD OF THE INVENTION

The present invention relates to automatic mail insertion devices and in particular to a method and apparatus for rapidly opening envelope flaps to facilitate the high speed insertion of documents.

BACKGROUND OF THE INVENTION

Automated mass mailing machines for processing large quantities of documents have been in use for many years. Such machines typically include a folder which folds sheets into envelope size, an inserter track that receives and processes the folded sheets along with other inserts, and means for inserting the folded sheets into envelopes.

The inserting means can comprise an envelope opening means that includes a plow member positioned adjacent the inserter track. As the envelopes are moved down the inserter track, they contact the plow member whereby the plow member is interposed between the rear surface of a moving envelope and the envelope flap to force the flap into a fully opened position. The opened envelope is then passed to an inserting station where the folded sheets and inserts are automatically inserted into the envelope. Thereafter, the stuffed envelope is sealed for mailing.

One problem associated with such envelope opening devices is the sticking of envelopes which occurs when the mailing machine is operated at a high speed and the plow member does not properly separate the envelope flap from the rear surface of an envelope.

Such sticking is a common problem because of the way envelopes are made and stored. Envelopes are stacked tightly together with the envelope flap folded against the rear surface of the envelope. This eliminates any natural spacing between the envelope and its flap caused by the resiliency of the creased paper. In addition, the flaps are usually treated with a moisture sensitive adhesive for sealing. Even when the envelopes are not subjected to moisture before processing, this adhesive often causes the flaps to adhere slightly against the envelopes.

Several attempts have been made to provide an apparatus that separates envelope flaps from envelopes so that the plow member can readily be inserted. For example, U.S. Pat. No. 3,583,124 to Morrison discloses an envelope flap opening apparatus that includes a suction cup mounted on a rotatable shaft and positioned alongside an envelope conveyer means. After the suction cup makes contact with the flap of an envelope traveling on the conveyer, a vacuum is applied to the suction cup. The suction cup then engages the envelope flap and rotates about the axis of the rotatable shaft away from the plane of the conveying means, thereby partially opening the flap. A plow member assembly rotates in the direction of the flap until a vertical head portion of the plow member contacts the leading edge of the partially opened flap. The plow member then forces the flap to a fully opened position.

The envelope flap opening apparatus described in the Morrison patent requires that the conveying means and the envelope are stopped for a dwell period in the machine cycle. The dwell period is necessary to permit the suction cup to engage the envelope flap; to rotate the suction cup and the envelope flap adhering thereto away from the plane of the conveying means; and to force the flap into a fully opened position. Unfortunately, the dwell period increases production time and lowers the efficiency of the inserting apparatus.

U.S. Pat. No. 4,318,265 to Orsinger et al. discloses a envelope flap opening apparatus that includes a stationary plow member and a rotatable, slidable suction cup. The suction cup is mounted on a shaft that moves alongside an envelope conveyor. When the suction cup engages the envelope flap, the shaft rotates the suction cup to partially open the flap. The envelope and the engaged suction cup advance together until the partially opened flap contacts the stationary plow member.

While the envelope flap opening apparatus described in the Orsinger et al. patent does reduce the dwell period of the device, it has several drawbacks. The number of moving parts makes this device particularly susceptible to breakdown, which is a common problem in the operation of such high speed devices. In addition, while faster than the Morrison et al. apparatus, the Orsinger et al. apparatus operates at a limited speed because the suction cup must sealingly engage the envelope flap. If the operating speeds are too high, machine vibrations can interfere with the efficient operation of the apparatus.

Thus, an envelope flap opener is needed which is capable of high speed operation, is dependable and is less susceptible to breakdown than currently available machines.

SUMMARY OF THE INVENTION

The present invention relates to a method and apparatus for opening envelope flaps to facilitate the rapid insertion of letters and other inserts. The apparatus is used as a component of a machine that includes means for conveying a plurality of envelopes in a lateral direction, each envelope having a closed flap. The apparatus includes suction means having a suction member mounted on a rotatable shaft for rotational movement about the axis of the shaft. The suction member, however, is stationary relative to the lateral movement of the envelopes along the conveying means. Means is provided for rotating the shaft so that the suction member can engage the closed flap and lift the flap to a partially-opened position. Means for applying a vacuum is also provided which applies a vacuum that is sufficient to allow the suction member to engage the surface of the closed envelope flap and rotate the flap away from the plane of the envelope without impeding advancement of the envelope along the conveyor means. A stationary plow member positioned adjacent and downstream of the suction member fully opens the envelope flap as the envelope passes beneath the plow member along the conveying means.

The method comprises conveying an envelope having a closed flap along a conveying means, contacting the closed flap with a suction member mounted on a rotatable shaft by rotating the shaft until the suction member contacts the closed flap, applying a vacuum to the suction member sufficient to engage the closed flap to the suction member without impeding advancement of the envelope along the conveying means, rotating the shaft and thereby the suction cup to partially open the flap and contacting a plow member with the envelope so that the opened flap is moved to a fully opened position.

In an alternative embodiment, the step of releasing the vacuum on the suction member can be performed after the shaft and suction cup are rotated to partially open the flap and before the envelope contacts the plow member. As a result, the vacuum need only be applied when the suction member engages the flap.

Thus, the present invention allows for high speed processing of envelopes to prepare the envelope for the insertion of letters and other inserts. This high speed processing is accomplished with a minimum of moving parts thereby decreasing the possibility of mechanical breakdown.

DETAILED DESCRIPTION OF A PREFERRED EMBODIMENT

Figure 1:
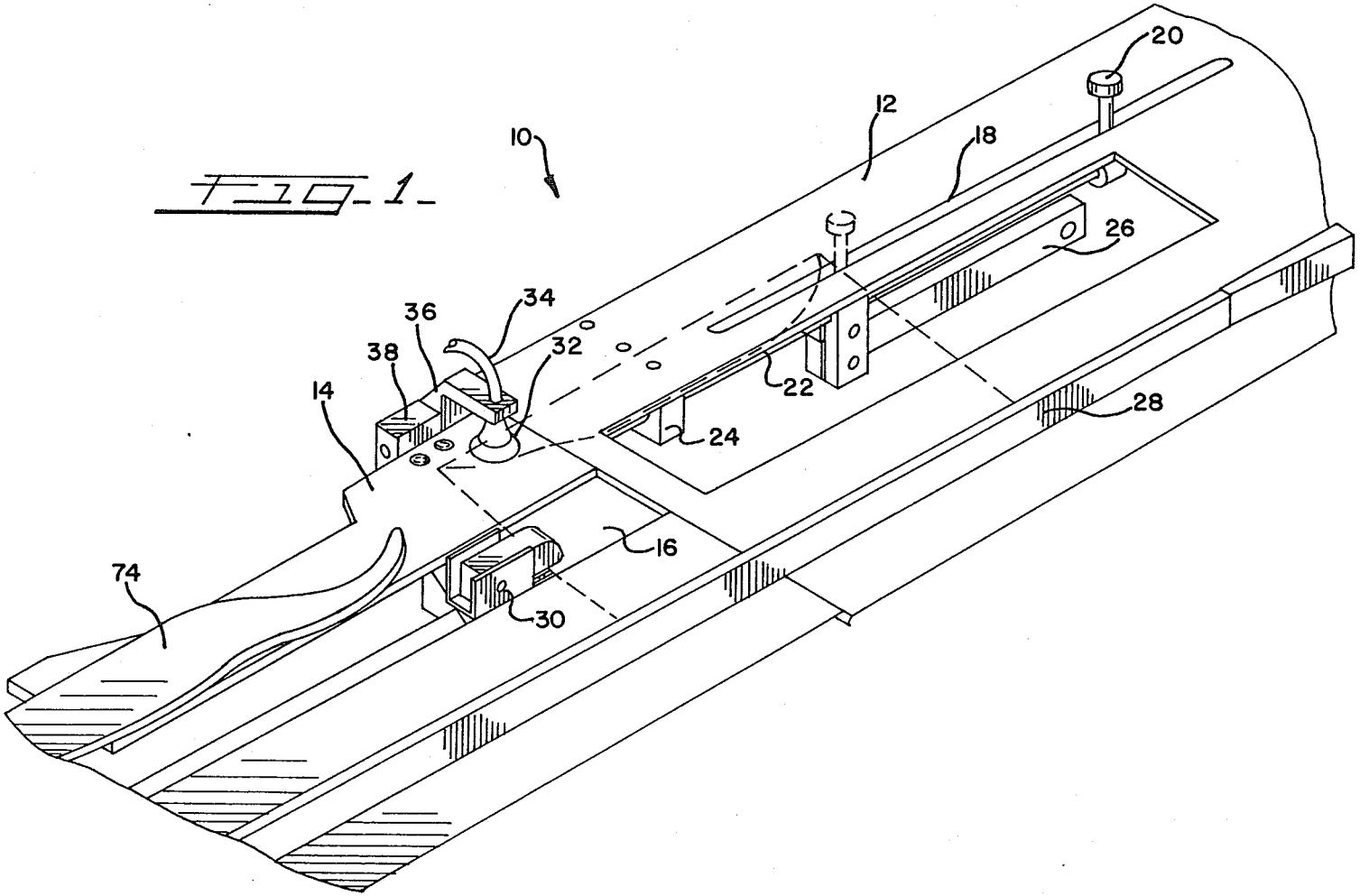
FIG. 1 is a perspective view of one embodiment of the present apparatus.

Referring to FIG. 1, the present invention is indicated generally by the reference numeral 10. Two tables, a posterior envelope rework table 12 and an anterior envelope staging table 14, are mounted on the main support structure of an automatic mailing machine. A grab arm aperture 16 is defined in the surface of the envelope staging table 14 while a kicker flap aperture 18 is defined in the surface of the envelope rework table 12. The top surfaces of each table are flush to allow envelopes to freely slide from the rework table 12 to the staging table 14.

An envelope feed mechanism (not shown) is positioned above the rework table 12. The feed mechanism stores a supply of stacked envelopes and delivers individual envelopes onto the rework table 12 as needed. As the individual envelopes are delivered to the rework table 12, they are pushed or propelled forward by an envelope kicker 20. The envelope kicker 20 is attached under the rework table 12 to an envelope kicker shaft 22 which is slidably supported in a sprocket 24. The envelope kicker shaft 22 is connected to the main drive train (not shown) by a connecting bar 26. The kicker shaft 22 is driven in a reciprocal sliding motion which propels each envelope towards the staging table 14 and then returns to its original position to repeat the process. A guide bar 28 is provided along the longitudinal axis of the rework table 12 and the staging table 14 to guide the envelopes.

As the kicker 20 pushes the envelopes towards and onto the staging table 14, an envelope grab arm 30 which is positioned in the grab arm aperture 16 engages the leading edge of each envelope. The grab arm 30 is attached to a conveyor (not shown) which is driven by the main drive train, thus pulling the envelopes through the staging area.

A suction member or cup 32 is connected to a source of vacuum through a flexible vacuum tube 34 which is secured about an aperture in the upper portion of the suction cup 32. The suction cup 32 is attached to a C-shaped arm 36 which is pivotally connected to a mounting bracket 38 fixably attached to the staging table 14. Thus, the suction cup 32 is pivotally supported over the anterior end of the staging table 14 and can be rotated about an axis that is parallel to the axis of the envelope movement.

In the envelope opening devices of the prior art, the suction cups were provided with a vacuum sufficient to adhere the suction cup to the envelope flap. To further enhance this adherence, the suction cups in the prior art are made of a high friction material such as soft, pliable rubber.

In addition, the suction cups and the envelope flap, as disclosed in the prior art, must move at the same speed to enable continued adherence. In U.S. Pat. No. 3,583,124 to Morrison, both the suction cup and the envelope flap are stopped for a dwell period to ensure the same speed. In U.S. Pat. No. 4,318,265 to Orsinger et al., the suction cup is advanced alongside the envelope flap in an attempt to maintain the same relative speed.

According to the present invention, the envelope flap is attracted to the suction cup 32 by the vacuum. However, the suction cup 32 need not move at the same speed as the envelope flap because the suction cup 32 only momentarily adheres to the envelope flap. A source of vacuum is provided that is sufficient to attract the envelope flap and to separate the flap from the envelope without impeding the movement of the envelope along the conveying means. The vacuum source can be adjusted by a suction valve to provide the proper strength of suction to pull or break the flap from the surface of the envelope. Moreover, the vacuum may be constant or intermittent depending on the particular application. To further prevent adherence of the suction cup to the envelope flap, the suction cup 32 can be made of a rigid, low friction material.

Figure 2:
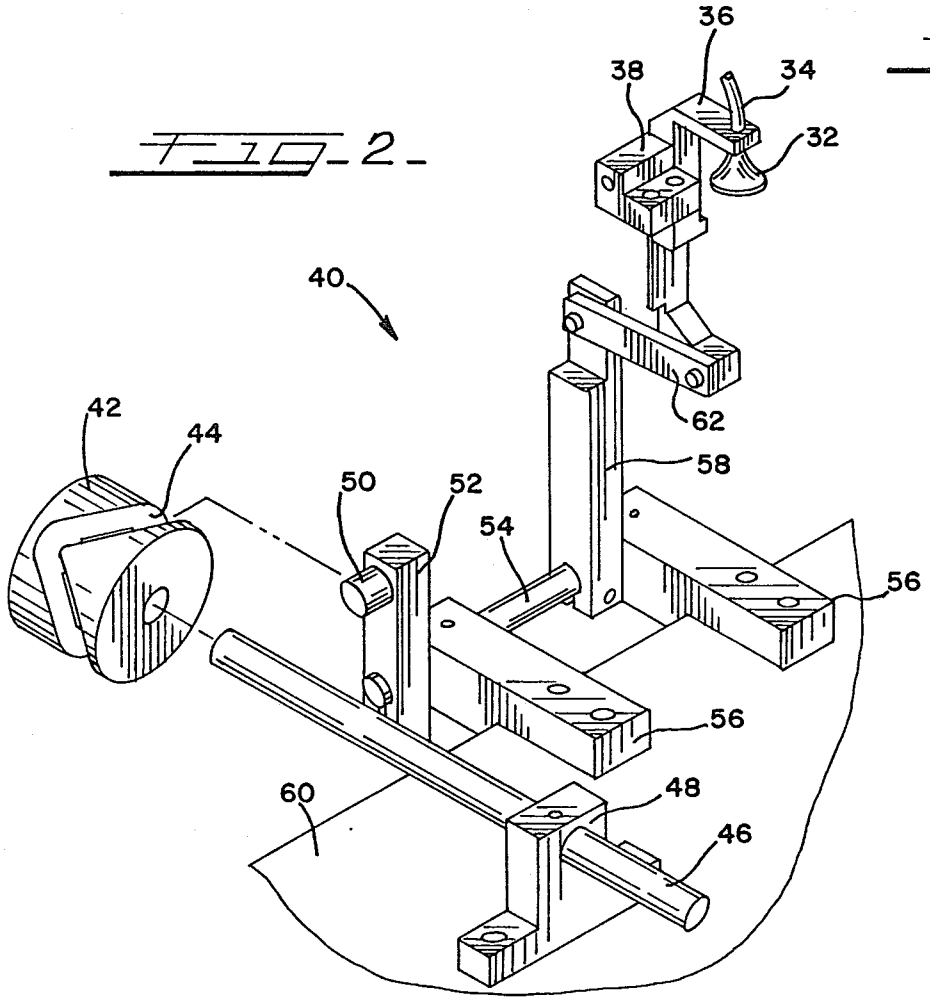
FIG. 2 is a perspective view of one embodiment of the pivot means of the present apparatus.

Pivotally connected to the loer end of the C-shaped arm 36 is means for pivoting the suction cup. In one embodiment as shown in FIG. 2, this pivoting means is mechanically-operated by a cam assembly. In an alternative embodiment shown in FIG. 3, the pivoting means is electrically-operated by a solenoid.

Referring first to FIG. 2, the means for pivoting the suction cup is shown generally as 40. A cam barrel 42 is attached to a drive shaft 46 which is rotatably journaled in a bracket 48 secured to a support structure 60. The drive shaft 46 is rotationally driven by the main drive shaft of the machine.

A cam follower 50 attached to a pivot shaft 54 by a cam follower arm 52 is provided to track a cam groove 44 defined in the cam barrel 42. The pivot shaft 54 is rotatably journaled in a pivot shaft bracket 56 which is also attached to the support structure 60.

At the anterior end of the pivot shaft 54, a pivot clamp arm 58 is fixably attached. The pivot clamp arm 58 is also attached at the end opposite the pivot shaft 54 to the lower end of the C-shaped suction cup arm 36 by a pivot link 62 which is pivotally attached to both the C-shaped suction cup arm 36 and the pivot clamp arm 58.

Thus, the main drive train rotates the drive shaft 46 causing the cam barrel 42 to rotate. As the cam barrel 42 rotates, the cam follower 50 tracks the cam groove 44 thereby imparting a rotational rciprocating movement on the cam follower arm 52. This movement is imparted to the pivot clamp arm 58 by the pivot shaft 54.

The rotational reciprocating movement of the pivot clamp arm 58 is transferred through the pivot link 62 to cause the C-shaped suction cup arm 36 to pivot on the pin provided through the suction cup arm mount bracket 38. This makes the suction cup 32 rotate away from the envelope staging table 14. The cam groove 44 is adapted to repeat this movement for each envelope processed.

Figure 3:
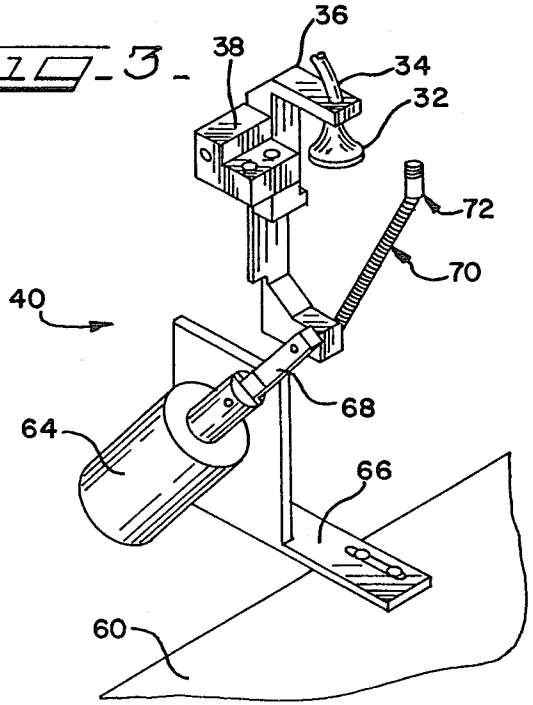
FIG. 3 is a perspective view of an alternative embodiment of the pivot means of the present invention.

Referring now to FIG. 3, the means for pivoting the suction cup is again shown generally as 40. A solenoid 64 is mounted on a solenoid bracket 66 which is fixably attached to the support structure 60. The solenoid 64 is pivotally attached to the lower end of the C-shaped suction cup arm 36 by a solenoid link 68 which is fixably attached to the solenoid 64. A bias spring 70 is also attached to the lower end of the C-shaped suction cup arm 36 and is attached to a threaded aperture (not shown) in the staging table by a threaded spring pin 72, thus providing a bias against the solenoid 64.

The action of the solenoid 64 is controlled by a solid state switching device which also controls the suction valve. When activated, the solenoid 64 drives the C-shaped suction cup arm 36 to pivot on the suction cup mount bracket 38. This rotates the suction cup 32 away from the envelope staging table 14.

Referring again to FIG. 1, a plow member 74 is fixably suspended above the envelope staging table 14 and anterior to the suction cup 32. Thus, as the envelope proceeds through the envelope staging area, the envelope flap contacts the plow member 74.

The plow member 74 has a narrow-headed posterior portion for insertion between the envelope and the envelope flap. The thickness of the plow member rapidly increases anterior to the posterior head to force the envelope flap to a position perpendicular to the envelope plane. The width of the plow member rapidly increases anterior to the thickened portion and extends over the crease of the envelope flap. The plow member 74 thus forces the flap into a fully opened position and maintains the flap in an opened position so that the desired materials can be inserted into the envelope.

It should be understood that various modifications, changes and variations in addition to those herein discussed may be made in the arrangement, operation and details of construction of the elements disclosed herein without departing from the spirit and scope of the invention.

What is claimed is:

1. An apparatus for opening envelope flaps associated with a machine that includes means for conveying a plurality of envelopes in a lateral direction, each envelope having a closed flap, comprising:
   - suction means including a suction member mounted on a rotatable shaft for rotational movement about the axis of the shaft, but mounted in a stationary position relative to the lateral movement of an envelope along the conveying means;
   - means for rotating the shaft so that the suction member can engage the closed flap and lift the flap to a partially-opened position;
   - means for applying a vacuum to the suction means sufficient to lift the flap from the surface of the envelope without impeding the lateral movement of the envelope along the conveying means; and
   - a stationary plow member positioned adjacent the suction means to fully open the flap of the envelope as the envelope passes beneath the plow member along the conveying means.

2. The apparatus according to claim 1 wherein the means for rotating the shaft further comprises:
   - a rotatably driven cam including a cam groove that rotates the shaft and pivots the suction member;
   - a cam follower for tracking the cam groove; and
   - means that operatively connects the cam follower to the suction means whereby the suction member engages the envelope flap in response to the movement of the envelope along the conveying means.

3. The apparatus according to claim 1 whereupon the vacuum applying means provides a constant vacuum.

4. The apparatus according to claim 1 wherein the vacuum applying means provides an intermittent vacuum.

5. The apparatus according to claim 1 wherein the vacuum applying means provides a vacuum only when the suction member contacts the flap.

6. A method of opening an envelope flap comprising the steps of:
   - (a) continuously conveying an envelope having a closed flap in a lateral direction along a conveying means;
   - (b) contacting the closed flap with a suction member mounted on a rotatable shaft by rotating the shaft until the suction member contacts the closed flap;
   - (c) applying a vacuum sufficient to lift the flap from the surface of the envelope without impeding the lateral movement of the envelope;
   - (d) rotating the shaft to partially open the flap; and
   - (e) contacting a plow member with the envelope so that the partially opened flap is moved to a fully opened position.

7. The method according to claim 6 further including the step of releasing the vacuum on the suction member after the shaft is rotated to partially open the flap but before the envelope contacts the plow member.

8. An apparatus for opening envelope flaps associated with a machine that includes means for conveying a plurality of envelopes in a lateral direction, each envelope having a closed flap, comprising:
   - suction means including a rigid, low friction suction member mounted on a rotatable shaft for rotational movement about the axis of the shaft, but mounted in a stationary position relative to the lateral movement of an envelope along the conveying means;
   - means for rotating the shaft so that the suction member can engage the closed flap and lift the flap to a partially-opened position;
   - means for applying a vacuum to the suction means so that the flap adheres to the suction member; and
   - a plow member positioned adjacent the suction means to fully open the flap of the envelope as the envelope passes beneath the plow member along the conveying means.

9. The apparatus according to claim 8 wherein the vacuum applying means provides a vacuum only when the suction member contacts the flap.

10. The apparatus according to claim 8 wherein the means for rotating the shaft further comprises:
   - a rotatably driven cam including a cam groove that rotates the shaft and pivots the suction member;
   - a cam follower for tracking the cam groove; and
   - means that operatively connects the cam follower to the suction means whereby the suction member engages the envelope flap in response to the movement of the envelope along the conveying means.

11. The apparatus according to claim 8 wherein the means for rotating the shaft comprises:
   - electric control means for operating the suction means whereby the suction member engages the envelope flap in response to the movement of the envelope along the conveying means.

12. The apparatus according to claim 11 wherein the electric control means is a solenoid.

13. The apparatus according to claim 8 wherein the vacuum applying means provides a vacuum that is sufficient to lift the flap from the surface of the envelope without impeding the lateral movement of the envelope along the conveying means.

14. The apparatus according to claim 8 whereupon the vacuum applying means provides a constant vacuum.

15. The apparatus according to claim 8 wherein the vacuum applying means provides an intermittent vacuum.

16. An apparatus for opening envelope flaps associated with a machine that includes means for conveying a plurality of envelopes in a lateral direction, each envelope having a closed flap, comprising:

suction means including a suction member mounted on a rotatable shaft for rotational movement about the axis of the shaft, but mounted in a stationary position relative to the lateral movement of an envelope along the conveying means;

means for rotating the shaft comprising electric control means for operating the suction means so that the suction member can engage the closed envelope flap in response to the movement of the envelope along the conveying means and lift the flap to a partially-opened position;

means for applying a vacuum to the suction means so that the flap adheres to the suction member; and a plow member positioned adjacent the suction means to fully open the flap of the envelope as the envelope passes beneath the plow member along the conveying means.

17. The apparatus according to claim 16 wherein the vacuum applying means provides a vacuum only when the suction member contacts the flap.

18. The apparatus according to claim 16 wherein the suction member comprises a rigid, low friction material.

19. The apparatus according to claim 16 wherein the means for rotating the shaft further comprises:

a rotatably driven cam including a cam groove that rotates the shaft and pivots the suction member;

a cam follower for tracking the cam groove; and means that operatively connects the cam follower to the suction means whereby the suction member engages the envelope flap in response to the movement of the envelope along the conveying means.

20. The apparatus according to claim 16 wherein the electric control means is a solenoid.

21. The apparatus according to claim 16 wherein the vacuum applying means provides a vacuum that is sufficient to lift the flap from the surface of the envelope without impeding the lateral movement of the envelope along the conveying means.

22. The apparatus according to claim 16 whereupon the vacuum applying means provides a constant vacuum.

23. The apparatus according to claim 16 wherein the vacuum applying means provides an intermittent vacuum.

* * * * *